US008806826B2

(12) United States Patent
Mann

(10) Patent No.: US 8,806,826 B2
(45) Date of Patent: Aug. 19, 2014

(54) LOCKING PANEL VENEER SYSTEM

(75) Inventor: Matthew Mann, Peterstown, WV (US)

(73) Assignee: Matthew Mann, Peterstown, WV (US)

( * ) Notice: Subject to any disclaimer, the term of this patent is extended or adjusted under 35 U.S.C. 154(b) by 0 days.

(21) Appl. No.: 13/179,831

(22) Filed: Jul. 11, 2011

(65) Prior Publication Data

US 2012/0174516 A1 Jul. 12, 2012

Related U.S. Application Data

(60) Provisional application No. 61/362,740, filed on Jul. 9, 2010, provisional application No. 61/486,850, filed on May 17, 2011.

(51) Int. Cl.
*E04C 2/38* (2006.01)

(52) U.S. Cl.
USPC ..... 52/475.1; 52/478; 52/509

(58) Field of Classification Search
USPC ..... 52/475.1, 477, 478, 489.1, 511, 513, 52/506.05, 591.4
See application file for complete search history.

(56) References Cited

U.S. PATENT DOCUMENTS 1,386,554 A * 8/1921 Dalglish ..... 52/591.4
2,055,442 A * 9/1936 Jones ..... 52/489.1
2,120,195 A * 6/1938 Valenti ..... 52/513
2,483,346 A * 9/1949 Maul ..... 52/597
3,421,281 A * 1/1969 Harris ..... 52/483.1
4,262,464 A 4/1981 Ludowici
4,553,366 A * 11/1985 Guerin ..... 52/506.08
5,094,051 A * 3/1992 Miller ..... 52/235
6,055,787 A * 5/2000 Gerhaher et al. ..... 52/546
6,170,214 B1 * 1/2001 Treister et al. ..... 52/511
6,253,515 B1 7/2001 Kuelker
6,427,408 B1 8/2002 Krieger
RE39,091 E * 5/2006 Kuelker ..... 52/506.05
7,207,147 B2 4/2007 Price et al.
7,472,521 B2 1/2009 Bilge
7,581,365 B2 9/2009 White et al.
7,654,058 B2 2/2010 Hatzinikolas
7,716,891 B2 5/2010 Radford
7,841,147 B2 11/2010 Moran
7,895,800 B2 3/2011 Overgaard
7,926,237 B2 4/2011 Gerkes et al.
8,033,066 B2 10/2011 Griffiths
8,127,505 B2 3/2012 Lu et al.

(Continued)

*Primary Examiner* — Brian Glessner
*Assistant Examiner* — Adam Barlow
(74) *Attorney, Agent, or Firm* — New River Valley IP Law, PC; Michele L. Mayberry

(57) ABSTRACT

The present invention relates to the field of mortarless, stone-like veneer systems for walls. More specifically, the present invention relates to facade systems comprising a plurality of panels with surfaces for engaging other panels in the system and for resisting pullout of a panel once installed. Further provided are facade systems comprising a plurality of panels which provide stacked-stone corners for walls, columns, and posts when installed. Preferred are systems comprising modular facade panels having (i) a front face for forming part of a first facade, wherein the face is formed as a plurality of stacked stones and has a concave rectilinear polygonal outline configured for mating with adjacent panels when installed in a facade system; (ii) a back side with a suspension rail in communication therewith; and (iii) left and right sides for forming part of another facade in an intersecting plane. Such panel systems provide a seamless veneer with a strength nearing that of mortar-based systems but having the ease of installation provided by modular mortarless systems.

19 Claims, 11 Drawing Sheets

(56) References Cited

U.S. PATENT DOCUMENTS

| | | | | |
|---|---|---|---|---|
| 8,161,705 | B2 | 4/2012 | Pratt | |
| 8,191,327 | B2 | 6/2012 | Griffiths et al. | |
| 8,234,828 | B2 | 8/2012 | Macdonald | |
| 8,240,099 | B2 | 8/2012 | Hummel, III | |
| 8,286,401 | B2 | 10/2012 | Little | |
| 8,322,103 | B1 | 12/2012 | Kownacki | |
| 8,336,264 | B2 | 12/2012 | Sato et al. | |
| 2007/0151190 | A1 | 7/2007 | Huff et al. | |
| 2008/0155938 | A1* | 7/2008 | Attebery | 52/747.12 |
| 2010/0011688 | A1* | 1/2010 | Moran | 52/250 |
| 2010/0192495 | A1 | 8/2010 | Huff et al. | |

* cited by examiner

LOCKING PANEL VENEER SYSTEM

CROSS-REFERENCE TO RELATED APPLICATIONS

This application claims priority to and the benefit of the filing date of U.S. Provisional Patent Application Nos. 61/362,740 and 61/486,850 filed respectively on Jul. 9, 2010 and May 17, 2011, the disclosures of each of which are hereby incorporated by reference herein in their entireties.

BACKGROUND OF THE INVENTION

1. Field of the Invention

The present invention relates to the field of mortarless, stone-like veneer systems for walls. More specifically, the present invention relates to facade systems comprising a plurality of panels with surfaces for engaging other panels in the system and for resisting pullout of a panel once installed. Further provided are facade systems comprising a plurality of panels which provide stacked-stone corners for walls, columns, and posts when installed. Such panel systems provide a seamless veneer with a strength nearing that of mortar-based systems but having the ease of installation provided by modular mortarless systems.

2. Description of the Related Art

Conventional mortar-based facade systems, including brick and stone are as difficult to remove as they are to install. Although the strength of a mortar-based system is generally an advantageous feature, such systems are susceptible to a number of disadvantages. For example, installation of brick and stone using mortar requires favorable weather and temperature conditions to be sure the mortar sets properly. This limits installation, especially in areas where seasonal changes occur, to relatively dry and ambient conditions.

Another disadvantage to conventional stone and brick facade systems is that such systems are labor intensive, messy, and time consuming to install. Once mortar is mixed it must be applied within a certain time period before it dries out and is no longer useable. Often skilled contractors who have experience with stone and brick are required to install the facade in an aesthetically pleasing manner.

Mortar-based veneers are usually installed in a manner that leaves no air space between the veneer and the wall to which it is attached. Dry rot of the wall itself due to a lack of ventilation is a common problem for such systems. Further, if moisture seeps in behind the brick or stone veneer, mold, mildew, and deterioration of the wall can develop increasing the chance of failure of the veneer.

Buildings are known to settle for some time after construction, leading to movement of walls. Typical mortar-based systems do not allow or provide for very little allowance for such seismic movement. Often times a mortar-based veneer will crack in response to environmental changes and generally over time. Cracking allows for moisture to seep into the system and provides an opportunity for loosening of the stones or brick, which generally requires replacement of the mortal to salvage the veneer, and which in turn is typically an expensive endeavor.

In contrast, modular mortarless systems can be installed year round regardless of external weather conditions. Likewise, modular systems have the advantage of ease of installation, not requiring special skills and so can be installed by a range of installers, from the do-it-yourselfer to the trained stone mason. Even further, mortarless systems because they do not have to be adhered to the entire surface area of a wall can provide better ventilation and moisture removal than conventional mortar-based veneers.

Existing mortarless systems, however, do not have the advantage of strength to resist pullout of the modular panels. Modular mortarless systems are usually configured for convenience of manufacture at the expense of strength and aesthetic appeal. For example, there is usually minimal overlap, if any, between the panels of existing modular systems. With no overlap between the tiles, it is relatively easy to insert a tool between the panels and pry them away from the wall on which they are installed. Likewise, with readily apparent joints or seams between panels, it is usually instantly recognized that the system is a facade. Compounding the issue is that for ease of manufacture the panels are usually configured as a single universal shape panel. When panels of the same size and shape are installed together in a system it is typically quite easy upon visual inspection to identify the outline of each panel.

What is desired is a facade that has the appearance and strength of a stone and mortar installation, but which is cost effective to manufacture and install. Ease of installation is also a plus without compromising on aesthetic appeal. Thus, what is needed is a modular, non-mortar system that addresses the disadvantages of conventional mortar-based systems, but has the strength, ease of installation, and aesthetic appeal of and aesthetic similarity to these conventional systems.

SUMMARY OF THE INVENTION

Embodiments of the invention include, among other things, facade systems, panels for facade systems, and brackets for hanging panels in a system. In certain embodiments, the panels preferably comprise one or more surfaces for engaging or overlapping other panels in the system.

Facade panels of this invention encompass modular facade panels comprising: (i) a front face for forming part of a first facade, wherein the face is formed as a plurality of stacked stones and has a concave rectilinear polygonal outline configured for mating with adjacent panels when installed in a facade system; (ii) a back side with a suspension rail in communication therewith; and (iii) left and right sides for forming part of another facade in a different plane.

Suspension rails according to embodiments of the invention can comprise an elongated planar member, an upper and lower mounting bar, and means for receiving securing means for connecting the suspension rail to a substrate surface. Panels and facade system embodiments of the invention need not comprise a suspension rail with a particular configuration nor comprise all of these functionalities, however, preferred embodiments include the inventive suspension rails as well.

Receiving means for the securing means that is incorporated into the suspension rail can be of any configuration. For example, the suspension rail can comprise an elongated v-shaped groove disposed lengthwise below the upper mounting bar for receiving screws at any point along the width/length of the suspension rail. Holes, whether circular or oblong, can alternatively be included to receive screws and can be disposed at various point along the length of the suspension rail.

Ideally, the suspension rail has some flexibility incorporated into its structure or is comprised of a material that allows for flexing or bending or one or both of the mounting bars. Such functionality can include structure in the form of a c-shaped groove along the length of the suspension rail to which the mounting bar is in communication with. The c-shaped channel allows for the mounting bar to be flexed toward or away from the body of the suspension rail to allow for ease of insertion of the mounting bar into a facade system on installation.

Feet for embedding or attaching the suspension rail to the back side of a facade panel can also be incorporated into the suspension rail. The feet can be disposed at any angle relative to the body of the suspension rail, however, a perpendicular position is preferred. Additionally, it is preferred to connect the panel with the suspension rail in a manner to provide an air gap between the facade panel and the elongated planar member. The air gap will allow for any moisture that collects behind the panels to drain away from the system and not interfere with the connection between the panels and the wall surface after installation.

Panels according to the invention can also comprise additional surfaces for engaging other panels of a facade system. For example, the panels can comprise a top side or edge configured for engagement with a bottom side or edge of another panel and can comprise a bottom side configured for engagement with the top side of another panel when panels are installed. This functionality can be accomplished in a number of ways, but a suggested embodiment includes incorporating a stepped surface into the top and bottom sides of the panel that cooperate with respectively bottom and top sides of adjacent panels. The stepped configuration at the top of the panel results in a protrusion with a surface recessed from the front face of the panel toward the wall, while at the bottom side there is a recess for receiving the top protrusion of another panel. Likewise, the protrusion formation can be incorporated into the bottom edge of the panel, while the recess is incorporated into the top. Similarly, these complementary protrusions and recesses can be incorporated into any side of the panel for resisting pull out of a panel from the wall once installed.

Specific embodiments of the present invention include facade systems comprising a plurality of panels, wherein each panel is operably configured to engage with other panels in the system on all sides of the panel. For example, for a square or rectangular tile, the tiles can be operably configured to engage on all four sides of the square or rectangular shape of the tile.

Typically, the stones, tiles, panels, etc. will have a stepped surface configuration for providing engaging surfaces. In embodiments, the stepped surfaces will be capable of providing engaging surfaces along the entire perimeter of the stone.

Preferred embodiments of the invention provide veneer systems, wherein the panels comprise elongated engagement surfaces with a total length of 50% or more of the perimeter of the panel. For example, in a square type panel each of the elongated engagement surfaces can comprise a length about equal to the length of one side of the panel. Preferred embodiments include panels capable of engaging 20%, 25%, 30%, 45%, 50%, 60%, 70%, 75%, 80%, 90%, 95%, 98%, or 100% based on length of the perimeter of the panel. Indeed, any amount of engagement in the range of 25% to 100% of the length of the perimeter is preferred.

Included in embodiments of the invention are veneer systems comprising at least two universal brackets for providing support against pullout of the panels. Each universal bracket (otherwise referred to as a suspension rail) can provide a surface for engaging another panel or for engaging with a corresponding bracket of another panel. Preferably, each bracket comprises an engagement surface substantially along the length of one side of the panel, or a major part of the length thereof, such as 50% or more. The brackets can also be configured to be a single piece providing one or more, typically two, additional engagement surfaces. Preferably, the bracket(s) are embedded in the panels during the manufacturing process or prior to installation to provide easy to install panels. The brackets, together with the length of the engagement surfaces provided by the panels themselves, can provide a total engaging length of 50% or more of the perimeter of the panel and up to 150% of the perimeter, or any engagement length between. Preferably, panels of the system with integral bracket(s) engage 100% to 150% of perimeter length.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described preferred embodiments of the invention. The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION OF VARIOUS EMBODIMENTS OF THE INVENTION

Reference will now be made in detail to various exemplary embodiments of the invention. The following detailed description is presented for the purpose of describing certain embodiments in detail and is, thus, not to be considered as limiting the invention to the embodiments described. More particularly, specific embodiments of the invention are described in reference to the drawings, however, it will be noted that the embodiments provided do not need to contain all elements described and can be combined with individual features of other embodiments described in this specification.

Figure 1:
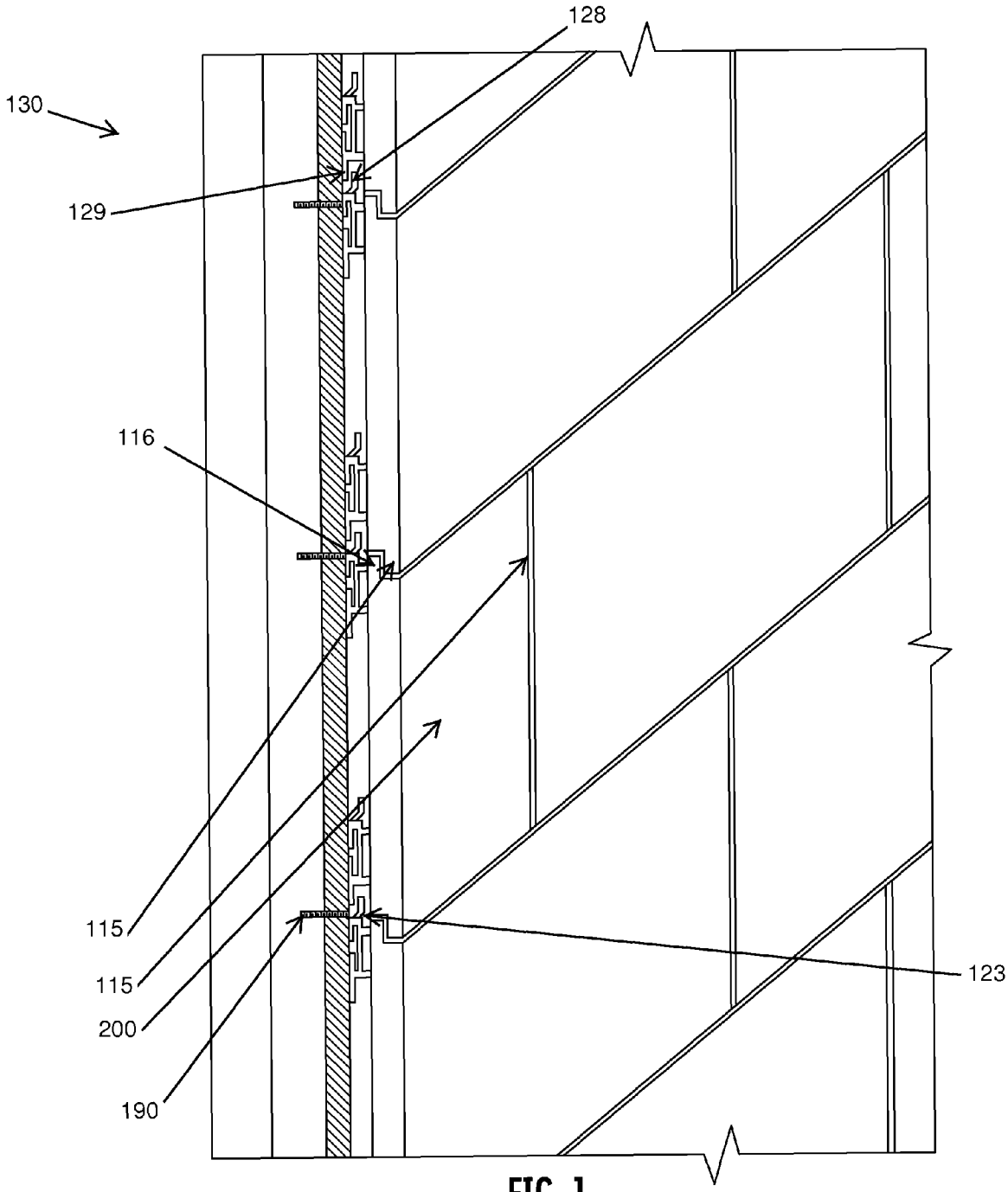
FIG. 1 is a schematic drawing of a mortarless veneer system according to an embodiment of the invention.

FIG. 1 provides a schematic diagram showing installation of a veneer system 130 according to the invention. This system, and any system or panel described in this specification, can be installed with or without mortar. One advantage of the systems of the invention is that mortar is not required, but can be optional for additional support, strength, or longevity of the overall system. As shown in FIG. 1, each panel 100 of this embodiment once installed on a surface resists pullout of the panel and adjacent panels by engaging or overlapping one or more adjacent panels along the panel itself or along their suspension rails, or a combination thereof. In this embodiment, the panels are installed on a wall surface by inserting screws 190 through v-shaped grooves 123 in the hanging brackets. Preferably, as shown, each panel comprises engagement surfaces for engaging at least three sides of the panel with at least three adjacent panels in the system. The overlapping surfaces can be any combination of one or more surfaces of the panel itself or one or more surfaces of a bracket installed in the panel. More particularly, each panel in this embodiment has a vertical engagement surface 115, 116 (not shown) that overlaps with the vertical engagement surface of an adjacent panel. Each panel also has a horizontal engaging surface 115, 116 for overlapping with a horizontal surface of another panel in the system. The hanging bracket(s) provide two additional horizontal engagement surfaces 128, 129 for interacting with horizontal surfaces of other panels in the system. In this embodiment, the suspension rails are considered universal in that they can be incorporated into either the upper part or lower part of the tile and provide the same function. Preferred embodiments have four engaging surfaces on the panels themselves, such as on both vertical and both horizontal edges, and two additional engagement surfaces provided by the suspension rails.

In this manner, there are four surfaces along three sides of each panel that engage other panels upon an attempt to pull the panel out of the installed system. These four engaging surfaces cooperate to resist pull out of the panel from the veneer system. For square panels, the total length of the engaging surfaces would be about 90% or more of the perimeter of the face of the panel. For rectangular panels, the engaging length would be greater than 100% of the perimeter when the engagement surfaces of the hanging bracket are disposed along the longer sides as shown. Any amount of overlap between panels and/or their support brackets will provide resistance against pullout from the system. Preferred are panels having means for resisting pullout along two or more sides of the panel, especially one horizontal and one vertical side.

It is further important to note that when the panels are stacked in a typical offset manner with respect to one another, as shown in FIG. 1, resistance to pullout of one panel is distributed among all panels that abut the panel being pulled out. As force is exerted on a panel to pull it away from the wall, the panel engages with the two tiles immediately above due to the overlapping faces of the panels. As the panels immediately above the panel of interest begin to move away from the wall, those panels engage the panel of interest as well as the panels to the left and right of the panel of interest by way of the overlapping upper support brackets. As the panels to the left and right of the panel of interest are pulled away from the wall, the panels immediately below them and below the panel of interest are engaged by way of their lower support brackets. It is important to note that when referring to upper and lower support brackets in this specification it is also meant to include a single support bracket with upper and lower engagement surfaces. Although resistance to pullout from all abutting panels is not required for all embodiments of the invention, the strength of the system is increased by distributing the resistance to pullout among all of the abutting panels.

Figure 2A:
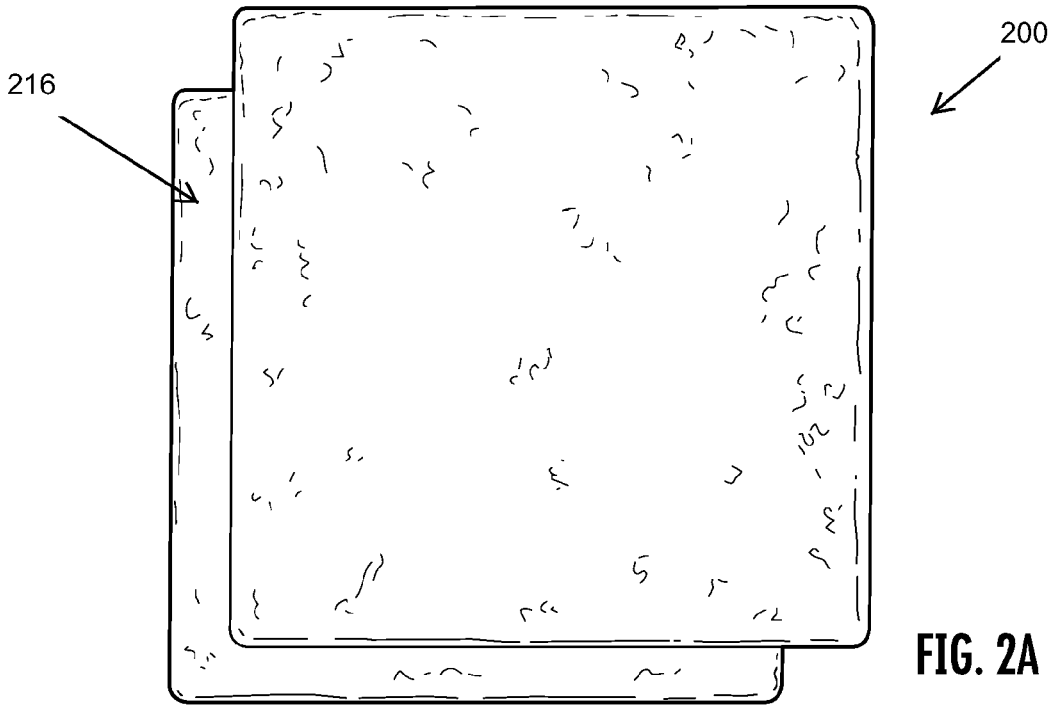
FIGS. 2A-E are respectively top and bottom planar views, a side elevation view, and top and bottom perspective views of an exemplary panel of the invention.

FIGS. 2A-E are respectively top and bottom planar views, a side elevation view, and top and bottom perspective views of an exemplary panel 200 of the invention. These panels can be installed in a veneer system using conventional mortar, adhesive, or screws. For additional resistance against pullout, hanging bracket(s) fixed or incorporated into the back of the panel can alternatively or additionally be used. As shown in FIG. 2A, the panel can be constructed of a light weight concrete product molded to form a locking stone veneer. The "locking" feature of this stone embodiment is a stepped surface 216. What is meant by locking according to this specification is that the structure is capable of overlapping with structure of an adjacent panel such that resistance is provided by the second panel against pullout of the first panel from the system. More particularly, the stone comprises a square face (but can be any shape) that is a planar surface with four sides and with or without beveled edges. A second planar surface is stepped a selected distance below the face and appears along two sides of the stone. In essence, the panel appears to comprise two identical shaped tiles stacked one on top of the other in an offset manner to provide two stepped surfaces 216. When installed in a panel system according to the invention, such a stone would be capable of engaging two other stones abutting the two sides of this stone along the exposed stepped surface area. What is meant by engaging according to this specification is that, when installed, the stepped surface 216 or any engagement surface of the panel or its bracket will resist against pullout of this stone or another stone from a veneer system according to the invention. Once installed, the back side of the top horizontal stepped surface 216 of this stone can be disposed in the panel system in a manner that provides this stone overlapping and in contact with a corresponding surface of a stone placed above this stone. Likewise, the back side of the side vertical stepped surface of this stone can be disposed in the panel system in a manner that provides this stone overlapping and in contact with a corresponding surface of a stone placed to the side of this stone. In this manner this stone will prevent pullout of the stone(s) above it and the stone(s) to the side of it due to the overlapping engagement surfaces.

The size of the stone panels is not critical. Preferred embodiments comprise small panels having a face that measures about 4 inches by about 8 inches, or a about a 0.22 sq. ft. face. A typical large size stone could have a face that measures about 10¼ inches by about 12¾ inches, or about a 0.91 sq. ft. face. Other stones could measure about 4 inches by about 17½ inches or with a 0.49 sq. ft. face, or about 4 inches by about 8¾ inches, or about a 0.24 sq. ft. face. Indeed, these shapes and sizes are meant to be exemplary rather than limiting and any shape or size panel can be used according to the invention. Similarly, any shape panel can also be used, including for example, square, rectangular, triangular, octagon, etc. shaped panels.

Further, any material can be used to manufacture the panels, including plastic, rubber, wood, stone, metal, glass, cement, ceramic, porcelain, or composite materials. A preferred stone-like material that is light weight can be manufactured from a combination of cement, aggregate, pigments, and admixes. Preferred materials are easy to mold into a desired shape or size and are of a consistency to allow for ease of embedding the support brackets into the material.

Figure 2B:
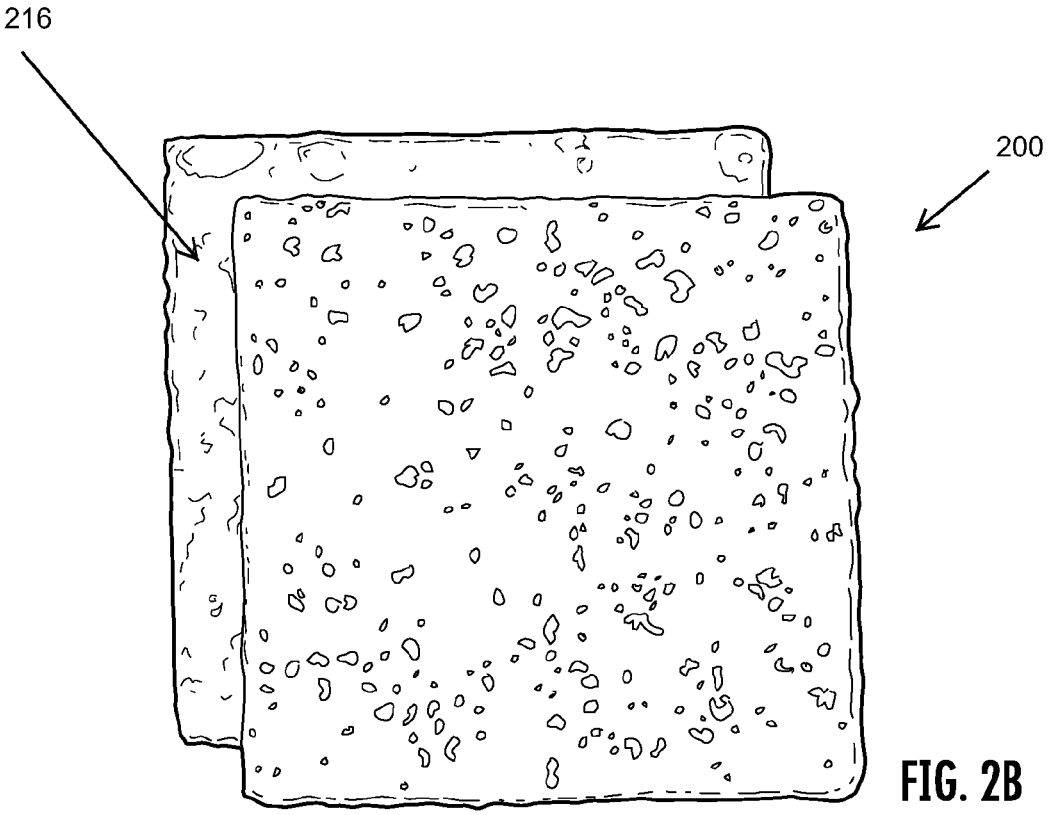

FIG. 2B is a bottom plan view of the panel 200 shown in FIG. 2A. The bottom (or underside) of the stone also has a planar face and a planar stepped surface 216 along the other two sides of the stone. The planar face of the stepped surface 216 on the underside of the stone, once installed, will act to prevent a stone placed vertically below this stone and a stone placed horizontally to the left of this stone from being withdrawn from the system. In essence, the stepped planar surfaces 216 on the top and bottom faces of the stone are capable of interlocking with the stones abutting this stone on all four sides of the stone. More particularly, the two planar stepped surfaces 216 viewable from the top provide resistance against removal of the stone from the system, while the two stepped planar surfaces 216 viewable from the bottom of the stone counteract removal of other stones adjacent to this stone in the system.

It is noted that for convenience only the orientations given in this specification, including top, bottom, above, below, right, left, vertical, and horizontal refer to viewing the system in its final installed form, in which the system is viewed from the front. Thus, to eliminate any confusion, when viewing the system from the back side of a panel 200 (as in FIG. 2B), the structure appearing on the right-hand side of the drawing is in essence the structure that would appear on the left-hand side of an installed system when viewing the face of such an installed system.

In preferred embodiments, the total length of all four stepped planar surfaces 216 totals more than 50% of the perimeter of the stone. In this embodiment, the top face of the stone is 4⅛ inches square with a perimeter of about 16½ inches. The bottom face of the stone is slightly smaller at 4 1/16 inches square with a perimeter of about 16¼ inches. The two stepped surfaces 216 of the top face are 4⅛ inches in length and the two stepped surfaces 216 of the bottom face are 4 1/16 inches in length. The total length of the stepped surfaces 216 is about 16⅜ inches. This corresponds with being about 99% of the length of the perimeter of the top face.

Figure 2C:
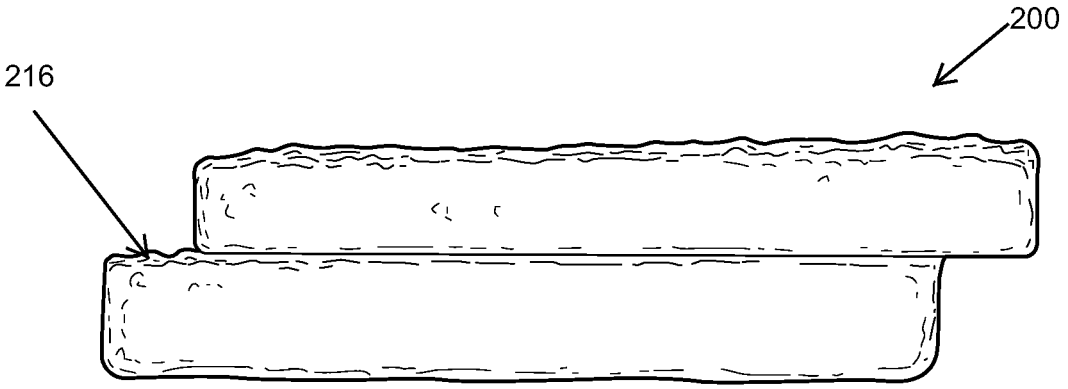
Figure 2D:
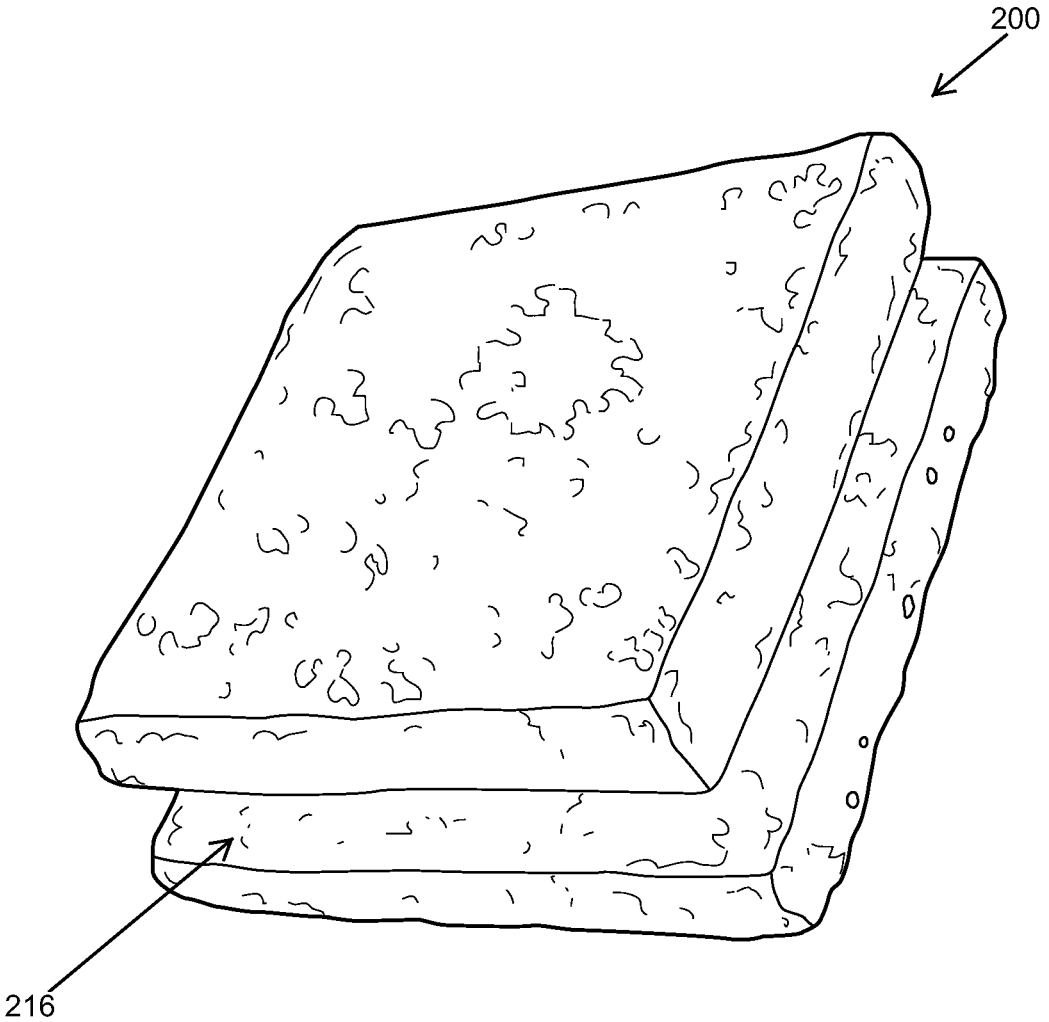
Figure 2E:
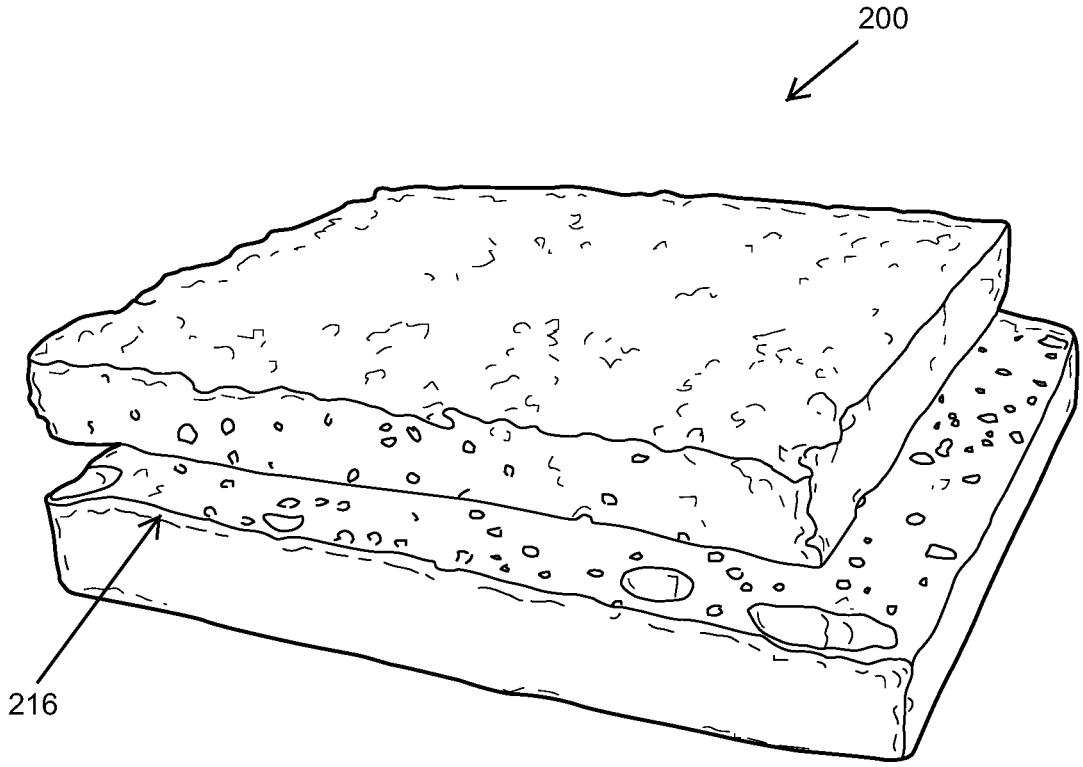

FIG. 2C shows a side elevation view of the panel 200 of FIGS. 2A-B, FIG. 2D shows a top perspective view, and FIG. 2E is a bottom perspective view. As shown in these figures, the stone in this configuration appears to have a top stone that provides the top face of the tile and a bottom stone that provides the bottom face of the tile, where the two stones are stacked slightly eccentrically. This embodiment is molded as a single piece, however, to obtain the two stepped surfaces 216, which are produced from the off center stacked-stone appearance.

Figure 3A:
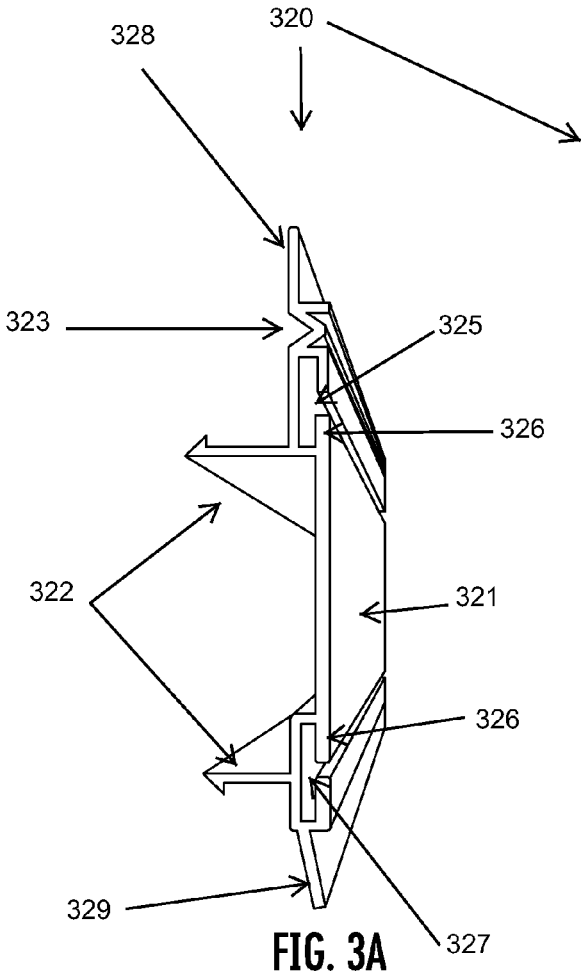
FIGS. 3A-C are respectively a side elevation view, a top planar view, and a bottom perspective view of a hanging bracket embodiment of the invention.
Figure 3B:
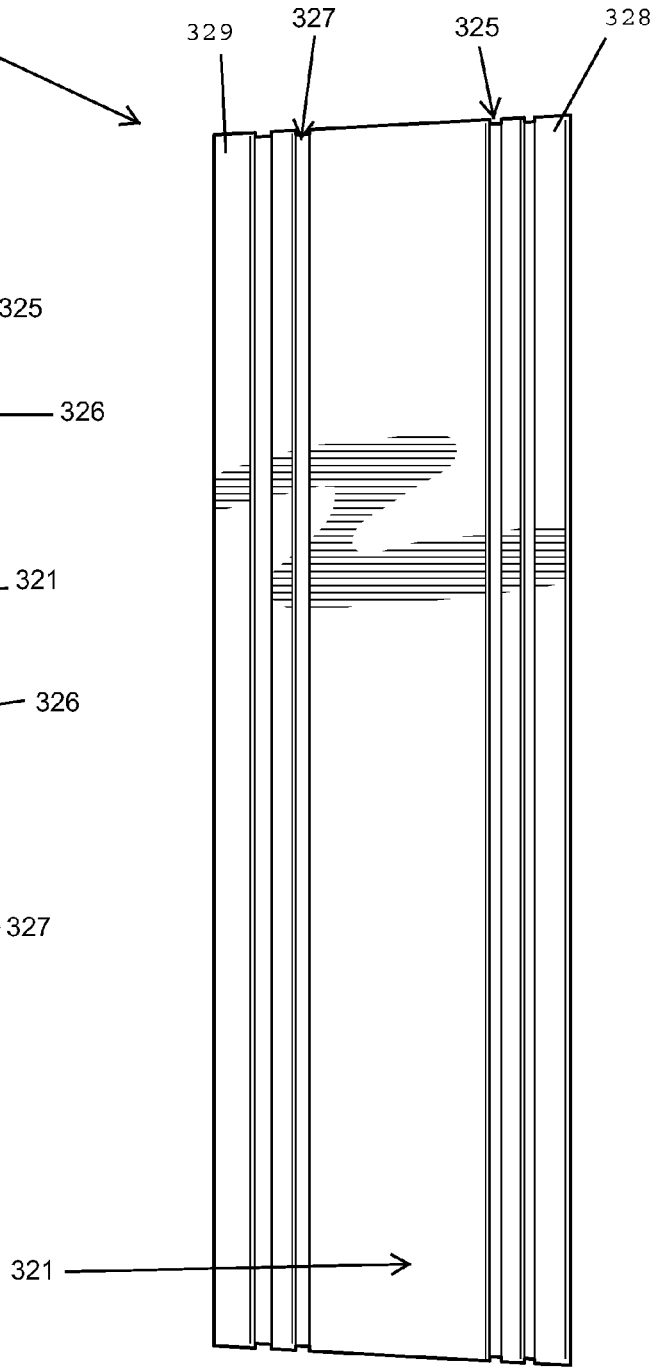
Figure 3C:
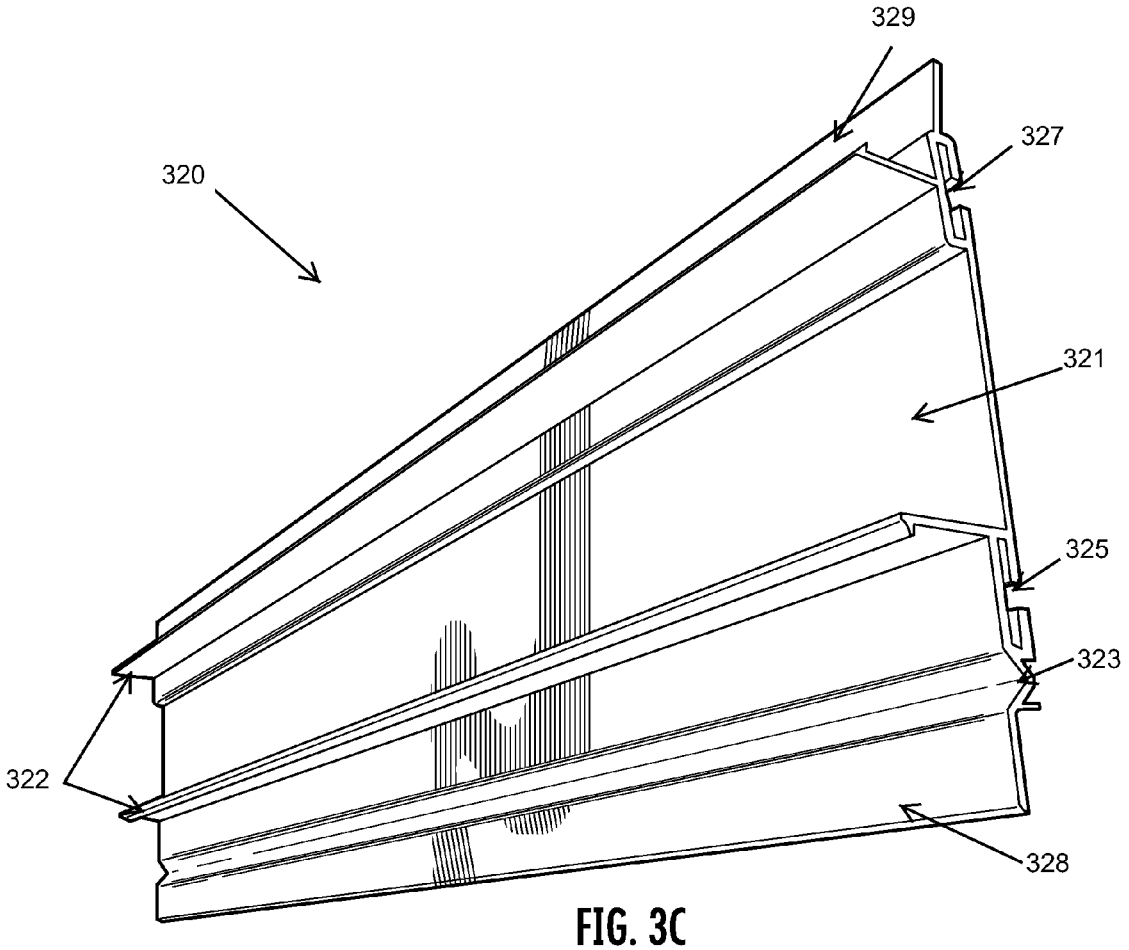

FIGS. 3A-C provide various views of a hanger embodiment according to the invention. Provided by this embodiment is a preferred suspension rail 320 comprising: an elongated planar member 321 with upper and lower longitudinal edges 326; upper and lower c-shaped channels 325 and 327 disposed along and formed in part by the longitudinal edges 326 of the planar member; one or more feet 322 in communication with the planar member 321 or c-shaped channel 325 or 327 and disposed perpendicular thereto; a v-shaped groove 323 disposed lengthwise along and in communication with the upper c-shaped channel 325; an upper planar mounting bar 328 disposed lengthwise along and in communication with the v-shaped groove 323 and parallel to the planar member 321; and a lower planar mounting bar 329 disposed lengthwise along and in communication with the lower c-shaped channel 327 and disposed at an angle in the range of about 135-180 degrees relative to the planar member 321.

A dual extrusion suspension rail 320 (used interchangeably with bracket or hanger or rail) for incorporating (eg, molding or forming) into each panel of the veneer system. As shown in FIG. 3A, the suspension rail 320 has a low profile planar body with protrusions or feet 322 extending from the body about perpendicular thereto. These protrusions or otherwise referred to as feet 322 facilitate embedding of the bracket into a material to be molded into a desired shape (ie, panel). Here, there are two feet 322 each of which comprises structure for preventing or resisting removal of the feet 322 from the panel material once cast or molded. These protrusions are integral to the body and in this embodiment made of the same plastic material as the body. The protrusions extend lengthwise along the body and can be molded into the panels of the invention to provide a panel with hanger that will resist pull out from the panel and not break free from the panel. Other means for securing the hanger to the panel can be used, such as posts instead of lengthwise planar elements, however, the more material of the hanger that is molded into the panel the more secure the hanger will be within the panel. Here, two feet 322 are provided, but any number can be used.

FIG. 3B shows the back face of the hanger, which comprises one or more grooves in the plastic material along the length of the bracket to provide flexibility in positioning of the engagement arms of the bracket. Any means for incorporating flexibility into the suspension rail 320 can be used, including using a plastic or metal material for the suspension rail body that is flexible enough to bend into a desired shape or has flexibility that allows for temporary bending of the suspension rail 320. Such flexibility is advantageous to allow for some variability in the positioning of the panel into a facade system during installation. As shown, another means for allowing some movement of the mounting bars 328 and 329 relative to the planar member 321 can be provided by the c-shaped channels 325 and 327 that extend lengthwise along the edges of the planar member 321.

With respect to the two elongated engagement arms (mounting bars) 328 and 329, these arms can be configured such that the bottom surface of one arm is capable of overlapping with the top surface of the other arm on a different bracket. When embedded in a manufactured stone, the universal brackets can be disposed in a manner to provide the elongated engagement arms 328 and 329 along the horizontal length of the stone at the top and bottom of the stone, or any part thereof. The engagement arms or mounting bars 328 and 329 need not be as long as the length of the panel to which they are connected, however, the greater the length of the suspension rail 320, the greater the strength of the system.

The bottom arm 329 of the bracket is capable of engaging or overlapping with the top arm 328 of another bracket of a panel disposed immediately below the panel being placed into the system. The surfaces that engage one another are the surface of the bottom arm 329 of a first panel that faces the panel and the surface of the top arm of another panel that faces away from the panel. Engagement in the context of this specification refers to overlapping surfaces and the surfaces need not physically be in contact with one another upon installation, however, a more stable facade system will result if there is an interference fit between engagement arms of the panels. Both engagement arms 328 and 329 are disposed in approximately the same orientation with respect to the stone. In preferred embodiments, the upper engagement arm 328 is disposed in a plane parallel to the planar member or body 321 of the suspension rail 320, while the lower mounting bar 329 is angled slightly toward the planar member 321. For example, the lower mounting bar 329 can be fixed at an angle relative to the planar member, such as approximately in the range of 135-180 degrees away from the top surface of the planar member. With the lower mounting bar 329 at a slight angle relative to the planar member 321 and thus relative to the upper mounting bar 328, insertion of that panel into the facade system is facilitated in that the lower engagement arm 329 can be inserted behind the upper engagement arm 328 of another panel immediately below the panel being installed and engagement of the two surfaces will be automatic due to the angle of the lower mounting arm 329.

Engagement of the engaging arms of the bracket(s) is also shown in FIG. 1. In some embodiments, the mounting bars in combination with the panel can provide four surfaces for engagement to resist pull out of the panel or adjacent panels away from the wall to which they are attached.

FIG. 3C shows the embedding feet 322 disposed lengthwise along the rail 320. As is further shown, structure can be incorporated into the lengthwise protrusions (ie, feet) 322 to provide additional pull out resistance, such as opposing hooks or directionally opposed hooks as shown. Another feature of the bracket is the V-shaped cut out 323. This provides a position for a screw or other securing means to be positioned when fastening the panel to the wall. For example, once a panel is positioned into a desired place within the veneer system, a screw can be used in combination with the V-shaped cut out to secure the stone panel to the face of the wall and provide the head of the screw in a recessed position with respect to the bracket. The advantages of such a system should be immediately apparent in that the panels can be secured quickly and easily to the wall and interlocked with one another to provide a strong veneer system without the need for mortar.

Other rail configurations are also included within the scope of the invention. Preferred are universal brackets that can be installed along any side of a panel without requiring a side-specific configuration. A universal bracket is smaller and requires less plastic material. Ideally, the universal bracket comprises two surfaces capable of engaging corresponding surfaces of another bracket of the same type, although only one engagement surface of the bracket is actually used to engage a similar surface of another panel. In other words, two universal brackets would be used for each panel as opposed to the single bracket described in FIGS. 3A-C. The base of the bracket can comprise at least two feet for facilitating the embedding of the bracket into a material to be molded into a desired shape. Here, there are two feet each of which comprises structure for preventing or resisting removal of the feet from the panel material once cast or molded. Another feature of the brackets is the two elongated engagement arms. The engagement arms are configured such that the bottom surface of one arm is capable of overlapping with the top surface of the other arm on a different bracket. With two pieces needed to accomplish the same function as the single piece bracket described above, manufacturing of the stone panels may be slightly more complex as placement of two brackets instead of one is required. Non-universal brackets can also be used, however, cost of manufacturing and complexity of the configurations may be unnecessarily increased.

Specific universal brackets can include brackets measuring about 2 inches by about 5½ inches for equipping a rectangular shaped extruded panel that measures about 11 inches long and 5½ inches wide. Again, it is not critical the size, shape, or material of any panel or bracket of the invention and dimensions and materials can be altered according to desired needs. The bracket(s) can be embedded in the panels during manufacturing in such a manner to dispose the brackets on the rear face of the panel. Although any number of brackets can be used to support a particular panel, such as 1, 2, 3, 4, 5, 6, 7, 8, 9, 10, and so on (limited only by the size of the panel and the size of the brackets), ideally two universal brackets are used (one at each of opposing sides of the panel) and are disposed along the entire length of the panel.

For example, one bracket measuring about 5.5 inches long could be positioned and embedded in one end of the panel that measures about 5.5 inches long. A second bracket (universal, i.e., of the same configuration as the first bracket) could be embedded at the opposing end of the panel that measures about 5.5 inches long. Such a panel would then be inserted into the veneer system with the shorter 5.5 inch sides disposed horizontally to enable the brackets of the panel to engage with the panels adjacent to it and disposed above and below the panel in the system.

Alternatively, one or two brackets could be disposed and embedded in the panel along the 11 inch sides of the panel. In this case, one bracket could be installed at each side (leaving about half the length of the 11-inch sides unsupported with a bracket) or two brackets could be disposed side by side along each 11-inch side so that the entire or substantially the entire length of each 11-inch side is supported by brackets. A panel operably configured in this manner would then be installed into the veneer system so that the 11-inch sides were horizontal.

Using smaller universal brackets in this way further increases ease of manufacturing in that the brackets can be used both for smaller and larger panels. More specifically, for example, two 5.5 inch brackets could be used on opposing sides of a square panel measuring about 5.5 inches on each side, or two or four 5.5 inch brackets could be used on an 11-inch side of a rectangular panel (as just described).

Yet another bracket embodiment can comprise engaging arms configured to be about the same length and width and disposed in parallel, adjacent or abutting horizontal planes. It is not critical the degree to which the planes in which the engaging arms lie are adjacent or if they abut one another, but it is important to note that the closer the clearance between the two, the tighter the fit between panels of the system and the less movement of the panels will be experienced post-installation.

An alternative embodiment of a bracket according to the invention includes another single piece rail. Incorporated into its configuration are the engaging arms, only just one bracket is needed instead of two to provide the corresponding top and bottom engaging arms disposed along the length of the panel at the top and bottom of the back portion of the panel. In this embodiment the base or body of the bracket hanger comprises at least two feet for facilitating the embedding of the bracket into a material to be molded into a desired shape. Here, there are four such feet each of which comprises structure for preventing or resisting removal of the feet from the panel material once cast or molded. The structure for resisting removal of the feet from the molded panel in this embodiment comprises a hook at the end of each foot. Here, the hooks are oriented in the same direction, but can be oriented in different directions as well. Another feature of the brackets is the two elongated engagement arms. The engagement arms are configured such that the bottom surface of one arm is capable of overlapping with the top surface of the other arm on a different bracket. When embedded in a manufactured stone, the brackets are disposed along the horizontal length of the stone at the top and bottom of the stone. Both brackets are disposed in the same orientation with respect to the stone. As shown, the bottom arm of the bottom bracket is capable of engaging or overlapping with the top arm of a top bracket of a panel disposed immediately below the panel being placed into the system. The surfaces that engage one another are the surface of the bottom arm of the bottom bracket (of a first panel) that faces the panel and the surface of the top arm of the top bracket (of another panel) that faces away from the panel.

Other embodiments of the invention include a veneer system for posts or columns. Preferred embodiments include a panel facade system 430 (see FIGS. 4 and 5A-B) comprising:

a plurality of facade panels 400, 500 each having a front face 410, 510 for forming part of a first facade, wherein the face is formed as a plurality of stacked stones and has a concave rectilinear polygonal outline configured for mating with adjacent panels when installed in the system; a back side 412, 512 with a suspension rail 420, 520 in communication therewith; and left and right sides 411 511 for forming part of another facade in a different plane. Such panel facade systems can comprise a group panels the combination of which is shaped to tessellate a surface that wraps around a 270 degree corner or that wraps around a 90 degree corner or both. What is meant by tessellate according to this specification is that the panel shapes fit together like a puzzle, whether on a planar surface or a combination of planar surfaces and corners, to form a facade with an annular-like rectangle or square configuration, meaning the surface of the facade is disposed in four planes perpendicular to one another. The panel facade systems preferably comprise a number of panels in which at least three of the panels have different front face outlines chosen from z-shaped 800, t-shaped 600, and inverted t-shape 700 outlines (see FIGS. 6, 7, and 8). The panels preferably in combination with each other are shaped to tessellate a surface that wraps around a post. Likewise, the panel shapes can be grouped to tessellate the interior surface of a room, such as around the base of a ceiling as crown molding, if desired.

Figure 4:
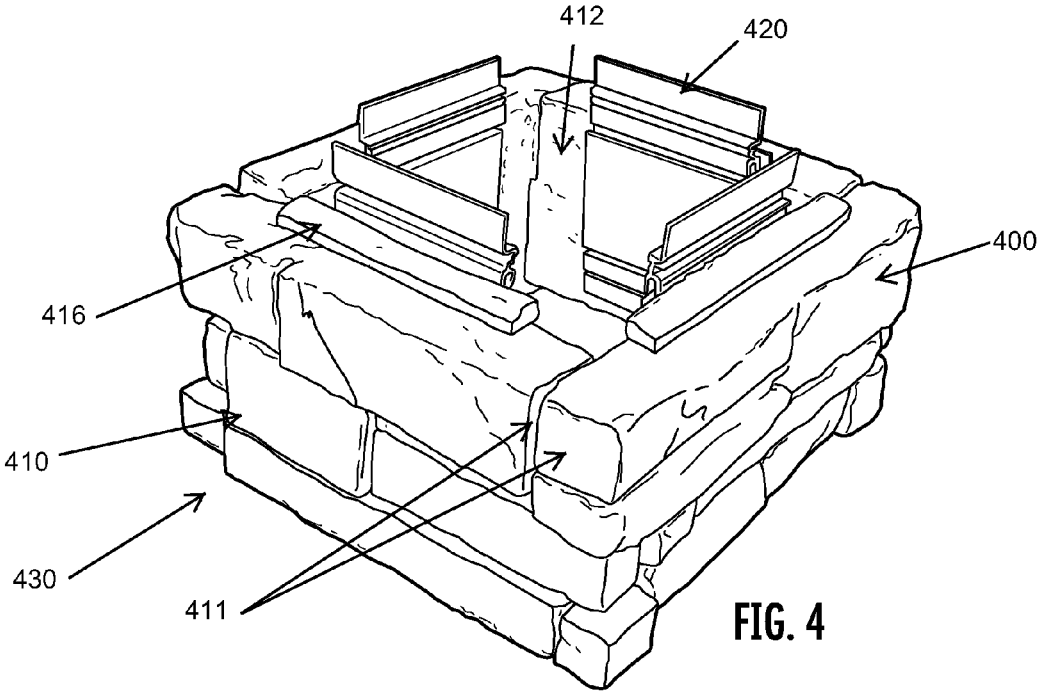
FIG. 4 is a representative post veneer system according to the invention, which provides for seamless corners.

FIG. 4 shows a perspective view of a 4-panel system for covering the sides of a post. As shown, rows of four panels around the circumference of the post can be arranged and stacked on top of previous rows until a desired amount of the post is covered. More specifically, four specifically shaped panels can be installed along four corresponding faces of a post. The four panel pieces are configured to cooperate with one another to interlock around the circumference of the post. Here, a cross section of the post is square, but any shape post can be used and appropriate sized panels selected for a particular design. The outline of the face of the panel pieces is preferably shaped in the form of a concave rectilinear polygon. In this manner the panels fit together like puzzle pieces so that the outline of each panel is difficult to determine upon visual inspection of the installed facade. Further camouflaging the joints between panels is the stacked stone appearance of the face of the panel. Due to the panel being divided up to look like a collection of several smaller stones, it is difficult to determine where the outline of the panel starts and stops. No other existing modular facade system provides this benefit.

On the interior face 412, 512 of each panel 400, 500 (back side or side installed on post) there is provided a hanger or bracket according to the invention. Any of the suspension rails 420, 520 described in this specification can be used, whether single piece or universal. The hanger or rail is preferably a single piece and universal that can be incorporated into the panel during manufacture of the panel or attached to the panel prior to installation. Alternatively, no brackets can be used and the panels can be installed on a post or wall corner using mortar. As shown, the hanger extends an amount above the panel in which it is embedded to provide for interlocking of the panels in the system by providing a surface for engaging with the hanger of another panel disposed on top. In this manner, each panel can be secured into the system by interlocking with a panel above and below. The bottom-most panel can be secured onto the post initially with a securing rail that provides an engagement surface for that panel's hanger. Alternatively or in addition, as with any embodiment of the invention, mortar, adhesive, or other securing means such as screws can be used. In preferred embodiments, a v-shaped groove is provided in which screws can be inserted at any point along the length of the suspension rail for hanging the bracket and panel to a surface. The v-shaped groove can further comprise structure (such as a groove) for supporting the head of screws and maintaining the screws in a certain position within the v-shaped receiving groove.

As shown, the finished product is especially advantageous because the modular nature of the system is not readily apparent. It has been found that panels comprising three or more "stones" on the face and where some of the stones are in a staggered configuration to one another provide a visually pleasing veneer system in that the outline of each panel is difficult if not impossible to detect by passersby.

Panels for providing a veneer to posts and columns according to the invention need not be of any specific shape or size and such will depend greatly on the particular application for which the panels are used. For example, when covering a post that is 4-inches square, the panels should be greater than 4-inches wide, such that the entire face of each side of the post may be completely covered by a panel. Further, it is preferred that each panel have finished "stone" that is visible from more than one side of the post. Especially preferred are panels that are visible from three sides of the post.

As shown in FIGS. 5A-B, 6A-B, 7A-B, and 8A-B the four panels constituting one row around the post have a specific interlocking configuration. Though the panels may differ in shape, each panel has three faces, such that the panel can be seen on three sides of a finished post, or in three of the facades of the post. More particularly, when installed as a veneer to a post, each panel has a first main face and two minor faces. The main face of the panel constitutes the majority of the surface area of one side of the post, while the two minor faces protrude into the surface area of a panel on adjacent sides of the post, such as the left and right sides of the post. In this manner, the individual panels of the finished post veneer system cannot be detected upon mere visual inspection. Such a panel system differs from existing modular corner covering systems in that each panel has an overall block or brick shape as opposed to the typical L-shaped configuration, which allows for the panel to be seen on another side of the post or corner joint of two walls. L-shaped panels are difficult to manufacture and are susceptible to breakage during shipping, installation, or other handling of the panel pieces due to their awkward, non-stackable shape. In contrast, panels of the invention can easily be stacked prior to shipping or installation. No other existing panel system comprises substantially planar panels with three faces that can be used for covering a flat wall surface, a concave corner surface, and a convex corner surface. Existing corner covering systems comprise a combination of planar panels and a variety of L-shaped panels to accomplish this goal. In contrast, the panels of the invention are universal in that they can be used to cover any surface.

As shown in FIGS. 5A-B, 6A-B, 7A-B, and 8A-B the four panels constituting one row around the post have a specific interlocking configuration. Though the panels may differ in shape, each panel has three faces, such that the panel can be seen on three sides of a finished post, or in three of the facades of the post. More particularly, when installed as a veneer to a post, each panel has a first main face 410, 510 and two minor faces 411, 511. The main face 410, 510 of the panel constitutes the majority of the surface area of one side of the post, while the two minor faces 411, 511 protrude into the surface area of a panel on adjacent sides of the post, such as the left and right sides 411, 511 of the post. In this manner, the individual panels of the finished post veneer system cannot be detected upon mere visual inspection. Such a panel system 430 differs from existing modular corner covering systems in that each panel 400, 500, 600, 700, 800 has an overall block or brick shape as opposed to the typical L-shaped configuration, which allows for the panel to be seen on another side of the post or corner joint of two walls. L-shaped panels are difficult to manufacture and are susceptible to breakage during shipping, installation, or other handling of the panel pieces due to their awkward, non-stackable shape. In contrast, panels of the invention can easily be stacked prior to shipping or installation. No other existing panel system comprises substantially planar panels with three faces that can be used for covering a flat wall surface, a concave corner surface, and a convex corner surface. Existing corner covering systems comprise a combination of planar panels and a variety of L-shaped panels to accomplish this goal. In contrast, the panels of the invention are universal in that they can be used to cover any surface.

Figure 5A:
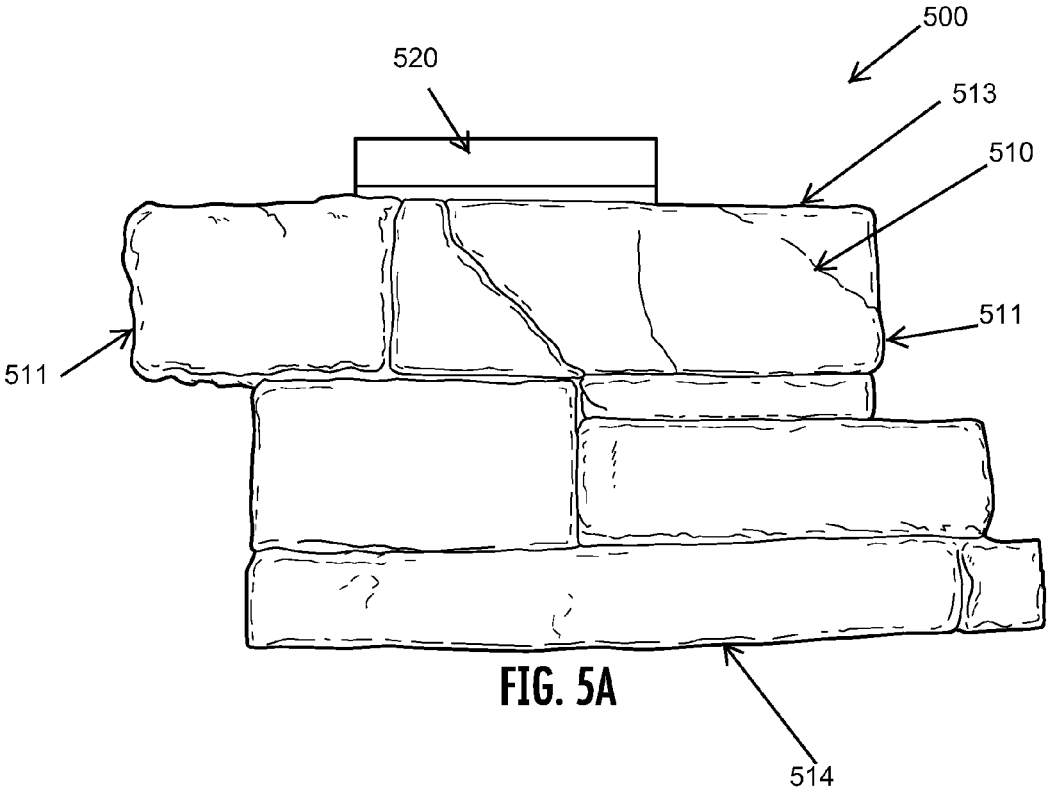
FIGS. 5A-B are front and back perspective views of a representative first panel embodiment of the system illustrated in FIG. 4.
Figure 5B:
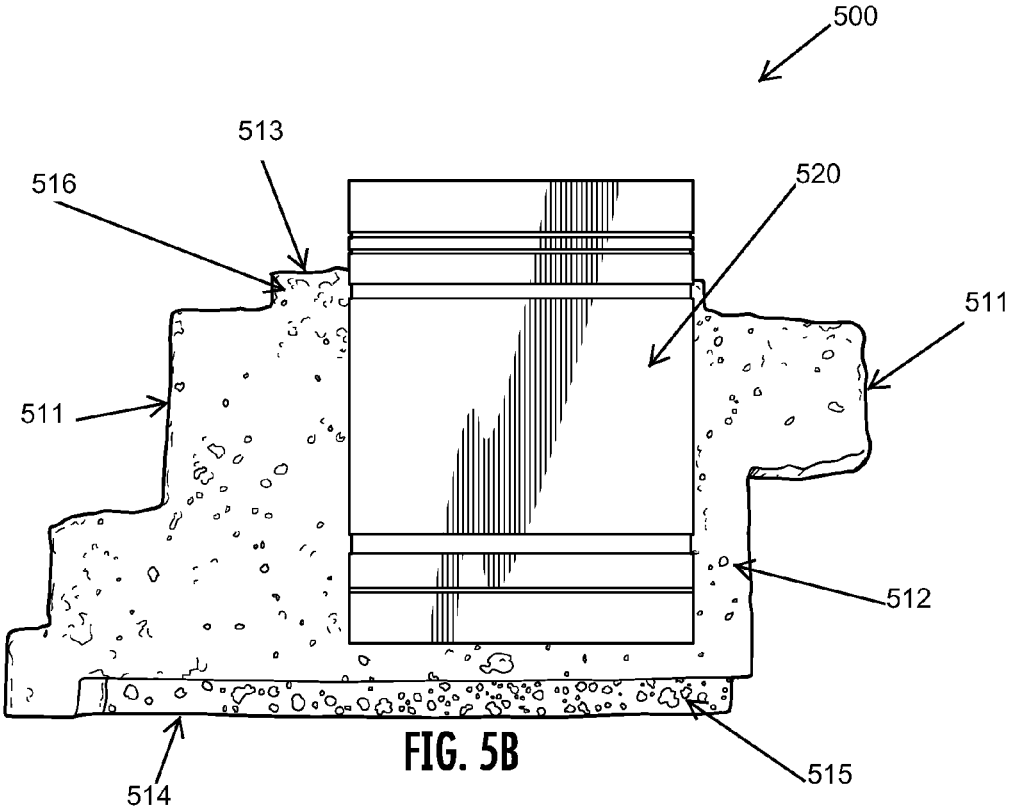

Provided in FIGS. 5A-B is a first panel 500 of the panel veneer system for covering posts according to an embodiment of the invention. Respectively, are front and back schematic diagrams of the proximal panel shown in FIG. 4. This proximal panel shows "stones" formed on the face of the panel in a staggered or offset configuration and stacked at least 3-4 stones high and at least 2 stones wide. The outline of the panel face is generally a z-shape polygon to provide three finished faces to the panel, a configuration that fits with other specifically shaped pieces, namely the t-shaped and inverted t-shaped panels, and to hide the overall outline of the panel when installed in the system. The stones can be molded or carved into the panel and as such are not actually discrete stones but merely give the appearance of being discrete stones. Panels 500 can also comprise a collection of discrete stones joined together by mortar or an adhesive, but such embodiments may have a reduced strength and are more complex from a manufacturing perspective and so are less preferred. Any number of "stones" or formations in the panel giving the appearance of individual dry stacked stones or individual stones joined together with mortar can be used. If the panel constitutes one stone, then it will be easier for observers of the facade to detect the outline of the individual panels and to identify the work as a modular system instead of the more desirable conventional brick and mortar look.

The inventors have found that panels 500 comprising the formation of a plurality of stones with at least two stones disposed in an offset manner relative to one another are preferred. For example, the panels can comprise only two stones, where the stones are stacked on top of one another in an offset manner. In such a configuration the panel is said to comprise two stones high and one stone wide. Further preferred are panels with at least three stones stacked high, wherein at least one of the stones is offset from another. What is meant by "offset" in the context of this specification is that where two stones abut, the abutting edge of at least one of the stones is not fully abutted by the abutting edge of the other stone. For example, an offset configuration can simply be achieved by having one stone with a first length and a second stone with a smaller length stacked immediately above or below the first, such that the longitudinal edges of the smaller stone do not line up with the longitudinal edges of the larger stone.

Another feature of embodiments of the invention is a modular facade panel comprising a front face 410, 510 formed as a plurality of stacked stones and a back side comprising a suspension rail, wherein an outline of the front face is a concave rectilinear polygon. Panels with this shape render the panel universal for any surface due to having three finished sides. As shown in FIGS. 5A-B, the left and right edges 511 of the facade panel 500 are staggered or offset to allow for the stones of this panel to protrude into the face of the facade on the left and right sides of the post or wall to which the panels are attached. In this manner, it is difficult to detect where the outline of each panel is thereby minimizing any negative aesthetic impact produced by the system upon installation. This configuration also allows for greater security of the panels within the system, as there are additional surfaces for engaging surfaces of other panels of the system to prevent movement of the panels once installed. These panels are universal in that they can be used to cover the planar surface of a wall whether or not a corner is being covered. Additionally, the panels can be applied to 90 degree corners (concave) or 270 degree corners (convex), without the need for special corner-specific panel pieces in the facade system.

As shown, each panel 500 in the system can also have a stepped configuration for providing additional engagement surfaces for securing the panels in the system. FIG. 5B shows a recessed surface 515 along most of the length of the bottom side 514 of the back of the panel. The recess 515 of this panel 500 can then be positioned in the system above a panel having a corresponding protrusion 516 along its top edge 513, as shown in FIG. 5A. (A similar protrusion 416 is also shown in FIG. 4). As shown in FIG. 5A, this first panel also has a protrusion 516 on the top edge 513 of the panel 500, which can be interlocked with a corresponding recess 515 of another panel disposed above this panel. The protrusions 516 of the system can be the same height and length for each panel 500 and the recesses 515 can be the same height and depth for each panel 500 so that any panel can be placed on top of any other panel in the system. The recesses 515 and protrusions 516 can be made to fit specific panels to ensure that a panel is not placed on top of an identical panel to ensure the individual panels remain undetected once installed in a system.

Figure 6A:
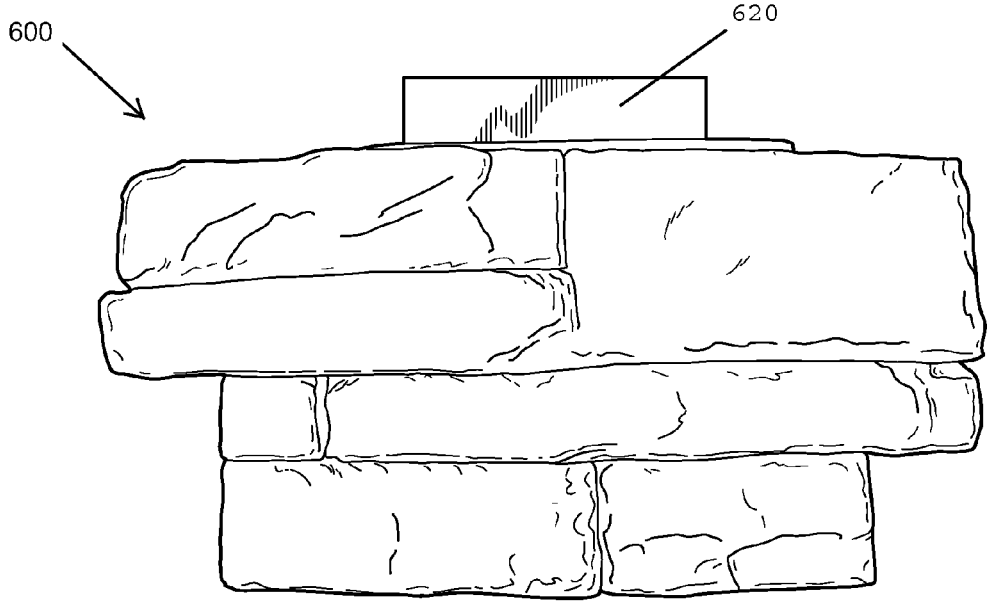
FIGS. 6A-B are front and back perspective views of a representative second panel embodiment of the system illustrated in FIG. 4.
Figure 6B:
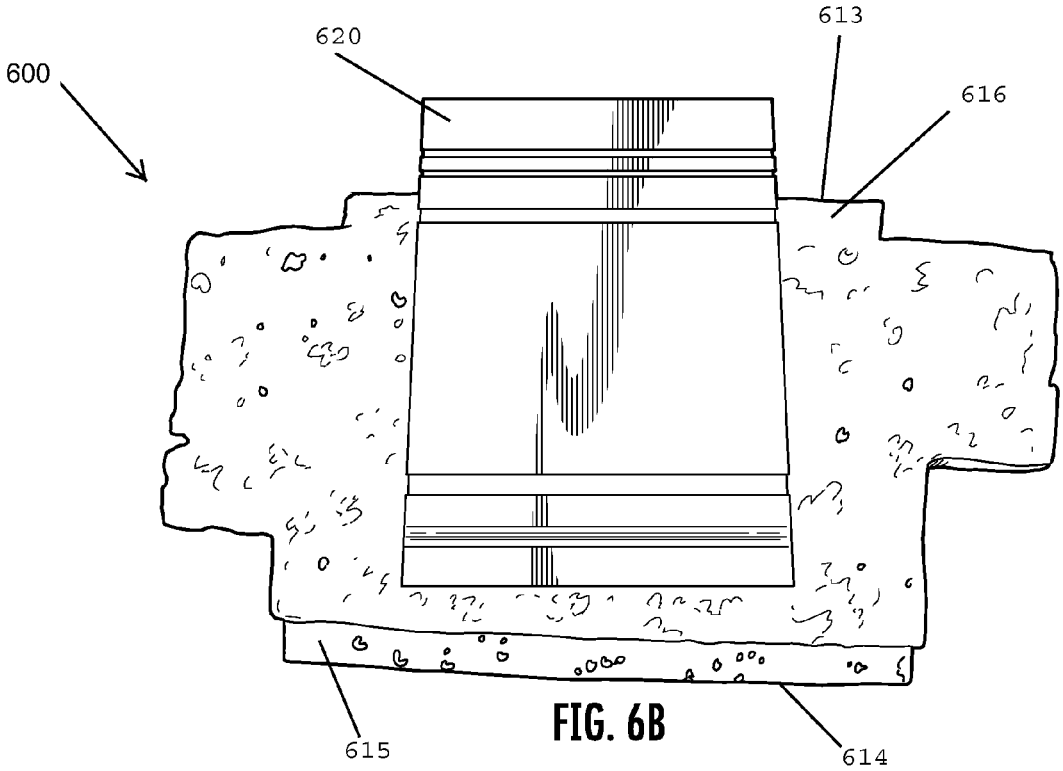

FIGS. 6A-B are schematic drawings of the front and back, respectively, of the right panel shown in the system of FIG. 4. This panel 600 comprises a suspension rail or hanger 620 integral to or embedded in the panel on its back side (side that faces or is installed on the post or wall) for interlocking with panels above and below the panel. Also included is a protrusion 616 along the top edge and a recess 615 along the bottom edge 614 for engaging complementary surfaces of panels above and below this panel in the system. The face of the panel has a staggered configuration and its outline is basically T-shaped for extending into the face of the facades formed by the proximal panel and the distal panel of the system shown in FIG. 4. This right panel comprises at least 3-4 stones in height and at least 2 stones wide.

Figure 7A:
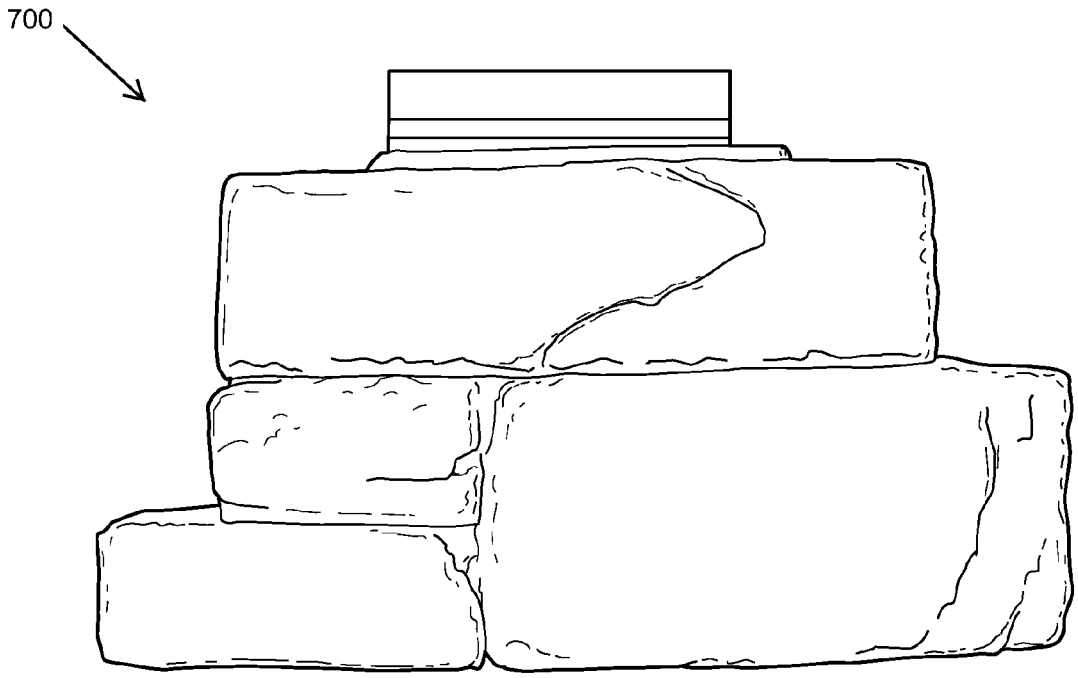
FIGS. 7A-B are front and back perspective views of a representative third panel embodiment of the system illustrated in FIG. 4.
Figure 7B:
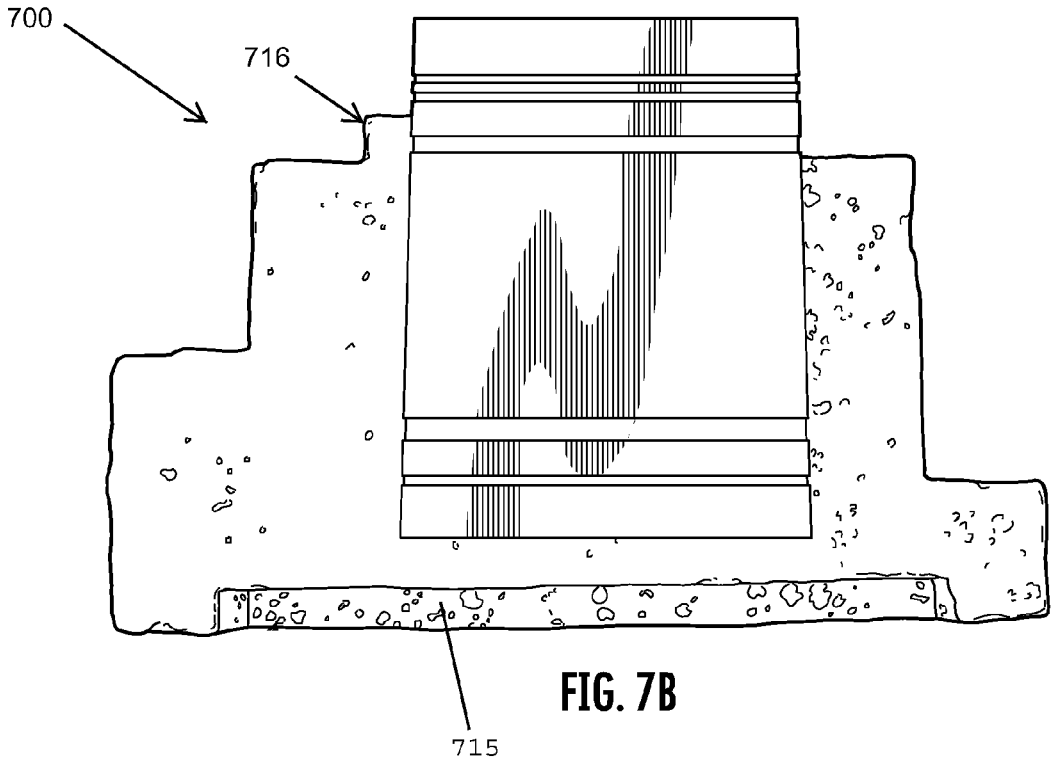

FIGS. 7A-B are front and back views, respectively, of the distal panel of the system shown in FIG. 4. This panel 700 has the outline of an inverted T-shape and is configured for protruding into the face of the right and left panels installed in the system. This distal panel comprises at least 2-3 stones high and at least 1-2 stones wide. As shown in FIG. 7B, the panel 700 can comprise stepped surfaces for securing multiple panels in the system, such as protrusion 716 and recess 715.

Figure 8A:
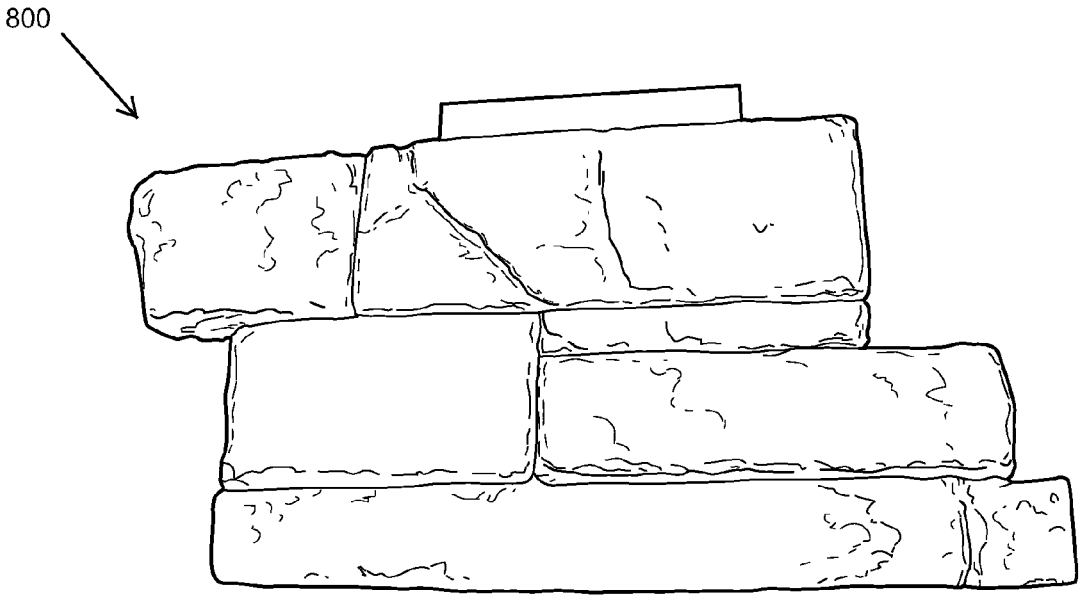
FIGS. 8A-B are front and back perspective views of a representative fourth panel embodiment of the system illustrated in FIG. 4.
Figure 8B:
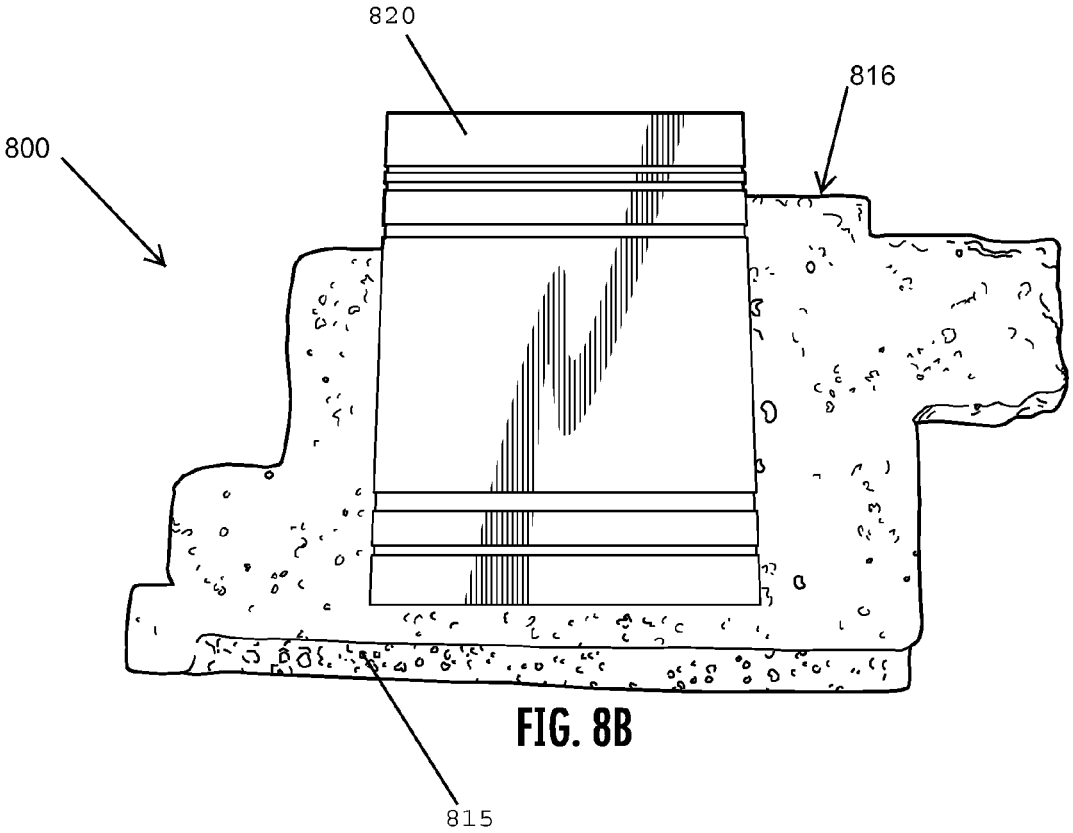

FIGS. 8A-B are views of the left panel of the system of FIG. 4. This left panel 800 is at least 3-4 stones high and at least 2 stones wide. This panel is configured to be the same overall shape and have a face with the same overall outline as the proximal panel. In this manner, only three distinct panels need to be used for each row of the system. The panels can be made of any configuration so that the panels of one row interact with each other and subsequent or previous stacked rows in the manner described, ie, interlocking with above and below panels at the panel face by way of protrusion 816 engaging with recess 815 of another panel 800 and/or hangers 820 and/or protruding into the face of adjacent panels.

Trim elements can be incorporated into the post systems of the invention, such as trim to be disposed around the base of a post or to top off the post to provide a finished look. Additionally, a cap stone can also be incorporated into the systems.

Embodiments of the invention provide a mortarless veneer system comprising: a plurality of panels for forming a facade on a substrate surface, wherein each panel comprises means disposed along two adjacent sides of the panel for resisting its removal from the facade and means disposed along two other adjacent sides of the panel for resisting removal of adjacent panels from the facade, and wherein each panel comprises at least one universal bracket, or a combination of two or more universal brackets, embedded in or otherwise integral to the panel, wherein the bracket or brackets together provide structure disposed along two opposing sides of the panel for resisting its removal from the facade.

Additionally, embodiments provide a mortarless veneer system comprising: a plurality of panels capable of interlocking with one another to form a facade on a substrate surface, wherein each panel is operably configured to comprise at least four planar surfaces for resisting its removal from the façade, and wherein each panel is operably configured to comprise at least four additional planar surfaces for resisting removal of adjacent panels from the facade.

Substrate covering systems are also included within the scope of the invention, including facade and veneer systems for walls and ceilings or any other planar surface of interest. Preferred embodiments include a wall covering system comprising: a plurality of panels for forming a facade on a wall, each having a front face with a perimeter of a selected length, wherein each panel has surfaces along its perimeter for engaging, in response to force, adjacent panels in the façade and the surfaces have a combined length of at least 50% or more of the length of the perimeter.

Also included in specific embodiments of the invention is a wall covering system comprising: a plurality of panels for forming a facade on a wall, each having a front face and a perimeter around the front face of a selected length, wherein each panel is operably configured with at least three planar surfaces for resisting its removal from the facade in response to force by engaging with at least two adjacent panels in the façade, and wherein the engaging surfaces have a combined length that is between 50% and 150% of the length of the perimeter.

Veneer systems comprising a plurality of panels each having a top face with a selected perimeter length; wherein each panel has a stepped surface configuration around its perimeter; such that, upon application of a pullout force applied to a panel: a) two of the stepped surfaces are capable of resisting removal of the panel by engaging with two adjacent panels in the facade; and b) two of the stepped surfaces provide pullout resistance for adjacent panels in the façade, are further embodiments.

Further embodiments include a veneer system comprising a plurality of panels each having a stepped top and bottom surface configuration and at least one universal bracket embedded in or otherwise integral to the panel, which, when installed as a facade and a central panel is surrounded on all sides by adjacent panels in the facade, all of the adjacent panels are capable of providing resistance to removal of the central panel due to the configuration of the stepped surfaces and the universal brackets. Even further embodiments include a wall veneer system comprising a plurality of panels having a top face with a perimeter of a selected length and operably configured, such that when installed on a wall, each panel adjacent to a central panel is capable of providing pullout resistance to the central panel along surfaces with a combined length that is about 90% or greater than the perimeter of the panel face.

Figure 9:
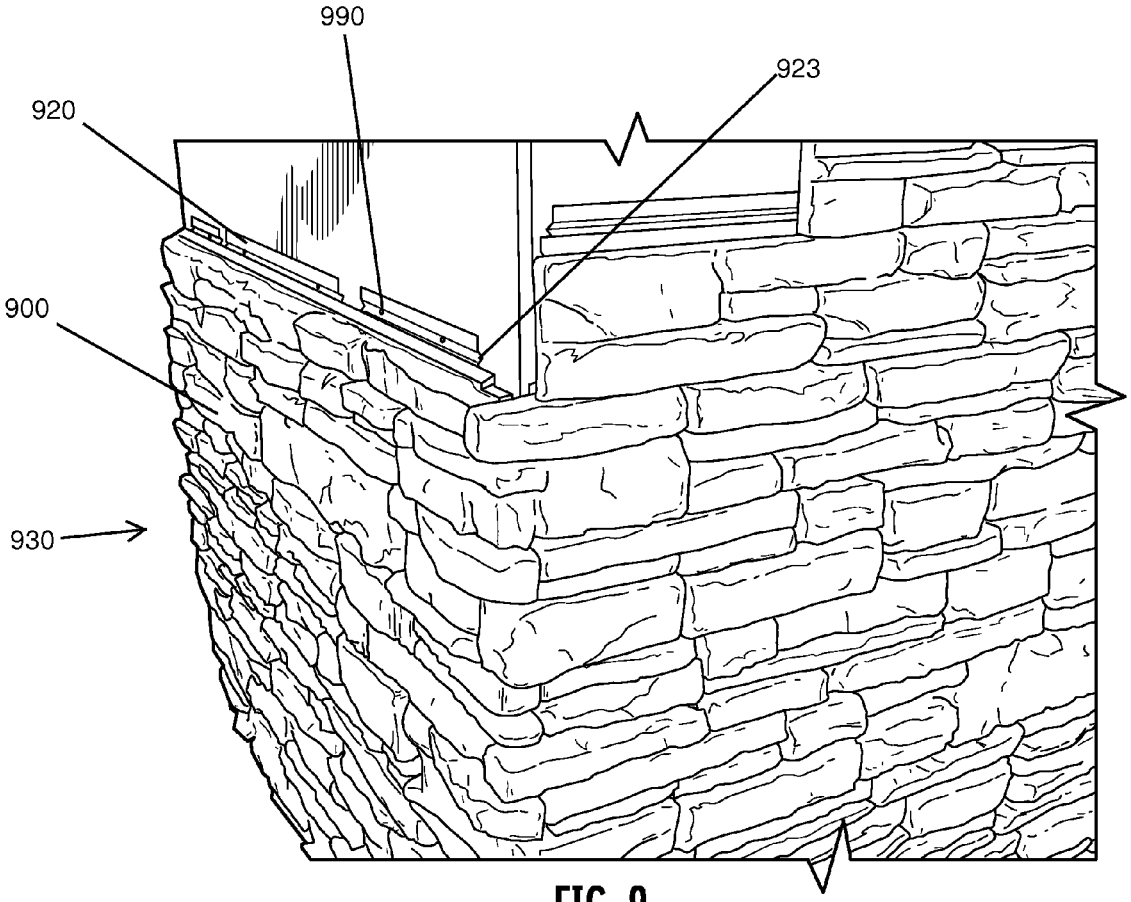
FIG. 9 is a representative veneer system according to an embodiment of the invention, which provides for seamless corners.

FIG. 9 shows a panel system 930 of the invention as installed on the corner of a wall surface. In this embodiment, the panels are installed on a wall surface by inserting screws 990 through v-shaped grooves 923 in the suspension rails. In this embodiment the panels 900 can be installed using suspension rails 920 of the invention and/or mortar. A mortarless system is shown in FIG. 9, which provides a close-up perspective view of a facade system applied to two planar surfaces and an intervening convex corner. Similar to the post system, the wall system in this configuration comprises panels 900 with the inventive hangers imbedded in the back side of the panel. Further security against pull out is provided by a protrusion and corresponding recess on the top and bottom edges of the panel for interlocking the panel surfaces with panel surfaces above and below each panel. The face of the panels is configured to have "stones" protruding into the face of an adjacent panel on the corner so as to make it more difficult for determining the outline of each panel and disguise the modularity of the system. The shape of the panels is such that the panels are combined in a manner to fit together to completely cover the wall and corner surfaces without the overall outline of each panel being detected.

Chair rail embodiments are encompassed by the invention as well. Some embodiments can include a suspension rail for attaching the chair rail to a wall and within a facade system according to the invention. More particularly, the chair rail can be used to top off a wall system at any point along the surface of the wall. A hanger can be incorporated into the chair rail for installation. For example, the chair rail can be positioned along the top of the wall panel veneer system and rest thereon. Then the hanger can be secured to the wall with screws.

Modular fireplace stone surround systems are also included within the scope of this invention. The product components are provided in a system in which the product can be fitted to any height and width fireplace easily, conveniently, and without requiring further finishing of the stone. For example, the top of the fireplace surround can be provided in three or more component parts. A center diamond piece can be positioned on the wall in the desired location and attached thereto with the bracket incorporated therewith. Then the stones to be positioned along the length of the top of the fireplace can be cut to the desired length to fit the width of the fireplace. The cut ends of the stone are then placed adjacent the center diamond so that the unfinished ends are hidden by abutting up against a side face of the diamond. The finished ends of the stone (the uncut end) can then be positioned outwardly. Side surrounds to be placed vertically along the sides of the face of the fireplace can be provided as two components, a finished base and a length of material that can be cut to the appropriate size. In this manner, the cut end of the stone can be placed in a position abutting the horizontal portion of the surround so that no unfinished ends are outwardly facing.

Additional embodiments include a structural support system for securing the panels to a wall, which includes holes in the horizontal support members to allow for the drainage of any fluid that may seep in between the veneer and the wall to which the veneer is attached. The brackets embedded in the panels can be secured to the vertical supports of this structural support system to allow for additional ventilation and/or drainage between the wall and the veneer.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

The manner of use and operation of the present invention should be apparent from the above description. It is to be realized that the optimum dimensional relationships for the parts of the invention, to include variations in size materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. No limitations are intended to the details of construction or design herein shown. It is therefore evident that the particular illustrative embodiments disclosed above may be altered or modified and all such variations are considered within the scope and spirit of the present invention. While embodiments of the invention are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an," as used in the claims, are defined herein to mean one, at least one, or more than one of the element that it introduces. If there is any conflict in the usages of a word or term in this specification and one or more patent or other documents that may be incorporated herein by reference, the definitions that are consistent with this specification should be adopted.

The invention claimed is:

1. A modular facade panel comprising:

a front face for forming part of a first facade, wherein the face is formed as a plurality of stacked stones and wherein an outline of a front planar view of the panel provides a concave rectilinear polygonal outline configured for mating with adjacent panels when installed in a facade system;

a back side with a suspension rail in communication therewith; and left and right sides for forming part of another facade in a different plane;

wherein the panel is configured such that, when a plurality of panels are disposed as a facade to a concave corner, a front of a first panel is capable of contacting a side of a second panel and a front of the second panel is capable of contacting a side of the first panel; and wherein the suspension rail of the first panel comprises a first horizontal mounting bar and when installed the first horizontal mounting bar overlaps a second horizontal mounting bar of a suspension rail of the second panel and is disposed between the second horizontal mounting bar and the second panel;

wherein the suspension rail of the first panel has a configuration that is the same as that of the suspension rail of the second panel.

2. The modular facade panel of claim 1, wherein the suspension rail comprises an elongated planar member, an upper and lower mounting bar, and means for receiving securing means for connecting the suspension rail to a substrate surface.

3. The modular facade panel of claim 2, wherein the means for receiving securing means of the suspension rail is an elongated v-shaped groove disposed lengthwise below the upper mounting bar.

4. The modular facade panel of claim 2, wherein the suspension rail comprises means for flexing a mounting bar toward or away from the planar member.

5. The modular facade panel of claim 2, wherein the suspension rail further comprises feet disposed perpendicular to the elongated planar surface and wherein the suspension rail is embedded in the back side of the facade panel in a manner to provide an air gap between the facade panel and the elongated planar member.

6. The modular facade panel of claim 1 comprising a top side configured for engagement with a bottom side of another panel and comprising a bottom side configured for engagement with the top side of another panel when panels are installed.

7. The modular facade panel of claim 6, wherein the top side comprises a protrusion with a surface recessed from the front face of the panel and wherein the bottom side comprises a recess for receiving the top protrusion of another panel.

8. A panel facade system comprising:

a plurality of facade panels each having a front face for forming part of a first facade, wherein the face is formed as a plurality of stacked stones and an outline of a front planar view of the panel provides a concave rectilinear polygonal outline configured for mating with adjacent panels when installed in the system;

a back side with a suspension rail in communication therewith; and left and right sides for forming part of another facade in a different plane;

wherein the system is configured such that, when disposed as a facade to a convex corner, a back of a first panel faces a side of a second panel and a back of the second panel faces a side of the first panel; and wherein the suspension rail of a first panel comprises a first mounting bar and when installed the first mounting bar overlaps a second mounting bar of a suspension rail of a second panel, and the first mounting bar is disposed between the second mounting bar and the second panel; and wherein the suspension rail of the first panel has a configuration that is the same as that of the suspension rail of the second panel.

9. The panel facade system of claim 8, wherein a group of the plurality of panels is shaped to tessellate a surface that wraps around a 270 degree corner or that wraps around a 90 degree corner or both.

10. The panel facade system of claim 8 comprising at least three different front face outlines chosen from z-shaped, t-shaped, and inverted t-shape outlines.

11. The panel facade system of claim 10, wherein a group of the plurality of panels is shaped to tessellate a surface disposed in four planes.

12. A mortarless veneer system comprising:

a plurality of panels collectively comprising a facade for a surface, wherein one panel face overlaps another panel face in the system;

a suspension rail operably connected with each panel for joining panels in the facade, wherein each suspension rail comprises means for resisting pull out of the panel from the facade disposed horizontally along two opposing sides of the panel, and wherein the suspension rail of a first panel comprises a first horizontal mounting bar and when installed the first horizontal mounting bar overlaps a second horizontal mounting bar of a suspension rail of a second panel and is disposed between the second horizontal mounting bar and a back of the second panel in a manner such that pull out of the second panel from the facade causes the first and second horizontal mounting bars to engage one another and resist the pull out;

wherein the suspension rail of the first panel has a configuration that is the same as that of the suspension rail of the second panel.

13. The veneer system of claim 12, wherein each panel and rail together provide at least four planar surfaces for resisting pull out of the panel from the facade and at least four additional planar surfaces for resisting pull out of adjacent panels.

14. The veneer system of claim 13, wherein each panel has a stepped surface configuration around its perimeter such that, upon application of a pullout force applied to a panel two of the stepped surfaces are capable of resisting removal of the panel by engaging with two adjacent panels in the facade; and two of the stepped surfaces provide pullout resistance for adjacent panels in the facade.

15. The veneer system of claim 12, wherein in addition to the upper and lower mounting bar of the suspension rail, each panel comprises means for resisting its pull out from the facade disposed along two adjacent sides of the panel.

16. The veneer system of claim 12, wherein in addition to the upper and lower mounting bar of the suspension rail, each panel comprises means for resisting pull out of an adjacent panel, which is disposed along two adjacent sides of the panel.

17. The veneer system of claim 12, wherein in addition to the upper and lower mounting bar of the suspension rail, each panel comprises means for resisting its pull out from the facade disposed along two adjacent sides of the panel and each panel comprises means for resisting pull out of an adjacent panel disposed along two other adjacent sides of the panel.

18. The veneer system of claim 17, wherein each panel has a stepped top and bottom surface configuration which, when installed as a facade and a central panel is surrounded on all sides by adjacent panels in the facade, all of the adjacent panels are capable of providing resistance to removal of the central panel due to the configuration of the stepped surfaces and the suspension rail.

19. The mortarless veneer system of claim 12, wherein the second horizontal mounting bar is disposed in a plane parallel to the back of the second panel and the first horizontal mounting bar is angled toward the first panel.

* * * * *